US006519558B1

(12) United States Patent
Tsutsui

(10) Patent No.: US 6,519,558 B1
(45) Date of Patent: Feb. 11, 2003

(54) AUDIO SIGNAL PITCH ADJUSTMENT APPARATUS AND METHOD

(75) Inventor: Kyoya Tsutsui, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/574,899

(22) Filed: May 19, 2000

(30) Foreign Application Priority Data

May 21, 1999 (JP) ..... 11-142516

(51) Int. Cl.[7] ..... G10L 11/04; G10L 19/02; G10L 19/14

(52) U.S. Cl. ..... 704/207; 704/204; 704/211

(58) Field of Search ..... 704/500, 200–220, 704/230, 268, 267, 221

(56) References Cited

U.S. PATENT DOCUMENTS

| | | | | | |
|---|---|---|---|---|---|
| 4,214,125 | A | * | 7/1980 | Mozer et al. | 704/207 |
| 5,369,730 | A | * | 11/1994 | Yajima | 704/267 |
| 5,567,901 | A | | 10/1996 | Roden et al. | |
| 5,581,652 | A | * | 12/1996 | Abe et al. | 704/220 |
| 5,642,466 | A | * | 6/1997 | Narayan | 704/200 |
| 5,819,212 | A | * | 10/1998 | Matsumoto et al. | 704/200.1 |
| 6,064,954 | A | * | 5/2000 | Cohen et al. | 704/207 |
| 6,212,496 | B1 | * | 4/2001 | Campbell et al. | 704/221 |
| 6,233,550 | B1 | * | 5/2001 | Gersho et al. | 704/208 |

FOREIGN PATENT DOCUMENTS

| | | |
|---|---|---|
| GB | 2240656 | 8/1991 |

OTHER PUBLICATIONS

T. Quatieri, et al., "Shape Invariant Time–Scale and Pitch Modification of Speech", IEEE Transactions on Signal Processing, IEEE,Inc., New York, US, vol. 40, No. 3, Mar. 1, 1992, p. 497–510, XP000294868.

* cited by examiner

*Primary Examiner*—Richemond Dorvil
*Assistant Examiner*—Daniel A. Nolan
(74) *Attorney, Agent, or Firm*—Sonnenschein, Nath & Rosenthal

(57) ABSTRACT

A signal processing method and apparatus is disclosed, which is capable of reproducing a coded audio signal by decoding it while shifting its pitch, and reproducing, from an original sound, a sound having a sufficiently higher pitch than the original sound with few operations and less cost for the decoder used in the signal processing apparatus, and an information serving medium for serving a program which implements the signal decoding and pitch shifting. In one embodiment, the method of providing a signal processing method for decoding a coded signal for reading, includes setting a pitch for the coded signal, decoding only a low frequency portion of the coded signal according to the set pitch, and shifting the pitch of the decoded read signal based on the set pitch.

16 Claims, 10 Drawing Sheets

AUDIO SIGNAL PITCH ADJUSTMENT APPARATUS AND METHOD

BACKGROUND OF THE INVENTION

1. Field of the Invention

The present invention relates to a signal processing method and apparatus in which a coded signal is decoded and its pitch is shifted, and an information-serving medium for serving a program which implements the signal decoding and pitch shifting.

2. Description of the Related Art

There has been known a technique for shifting the interval (pitch) of a sound signal by re-sampling the sound signal recorded in a pulse code-modulated (PCM) state at intervals different from those at which the sound signal has been sampled for pulse code compression (PCM). For example, a sound one octave lower than an original sound signal can be reproduced by reproducing, as sample values acquired at the original sampling rate, a two times larger number of sample values than that of the original sound signal sample values, acquired by sampling at a sampling rate two times higher than the original sampling rate within the same unit time as that for the original sound signal, while interpolating the difference between the original sound signal sample values, or by reproducing at the original sampling rate each of the samples acquired by re-sampling, by which the number original sound signal samples is halved. However, when a sound having a higher pitch than the original sound is reproduced (namely, the sound pitch is raised), so-called aliasing will take place. To avoid this, it is necessary to pass a signal yet to re-sample through a low-pass filter for example. In the above example, a part of the sample after being re-sampled coincides with the original sample. However, the sample part is not always necessary. Generally, by re-sampling the sound signal at an arbitrary rate while interpolating the difference between samples, it is possible to shift the interval (namely, to control the pitch).

On the other hand, a highly efficient coding method has been proposed to compress an audio or sound data with little degradation in sound quality of the data in hearing the sound. An audio signal can be coded with a high efficiency in various manners. The highly efficient audio data coding methods include, for example, a so-called transform coding being a blocked frequency band division method in which an audio signal on a time base is blocked in predetermined time units, the time base signal in each block is transformed (spectrum-transformed) to a signal on a frequency base, the signal thus acquired is divided into a plurality of frequency bands, and the signal in each subband is coded, and a so-called subband coding (SBC) being a non-blocked frequency band division method in which an audio signal on a time base is divided into a plurality of frequency bands without blocking it, and the signal in each subband is coded.

The subband coding (SBC) uses a subband filter which is a so-called quadrature mirror filter (QMF) or the like. The QMF filter is known from the publication "Digital Coding of Speech in Subbands" (R. E. Crochiere, Bell Syst. Tech. J., Vol, 55, No. 8, 1976). The QMF filter is characterized in that when two bands having the same bandwidth are recombined later, no aliasing will take place. More specifically, there is a fact that an aliasing taking place in a signal halved, for example, for the band division and an aliasing taking place in a signal synthesized by recombining the half signals, will cancel each other. Therefore, if the signal of each subband is coded with a sufficiently high accuracy, the QMF filter can eliminate almost perfectly the loss caused by the signal coding.

Also the publication "Polyphase Quadrature Filters—A New Subband Coding Technique" (Joseph H. Rothweiler, ICASSP 83, Boston) describes a polyphase quadrature filters which provide an equal-bandwidth division by filters. The PQF filter is characterized in that a signal can be divided into a plurality of equal-width subbands at a time and no aliasing takes place when the signals of the subbands are recombined later. More particularly, an aliasing taking place between a signal thinned at a rate for each bandwidth and an adjoining subband and an aliasing taking place between adjoining subbands recombined later, will cancel each other. Therefore, if the signal of each subband is coded with a sufficiently high accuracy, the PQF filter can eliminate almost perfectly the loss caused by the signal coding.

Further, the spectrum transform can be effected by blocking an input audio signal for predetermined unit times (frames) and transforming a time base to a frequency base by the discrete Fourier Transform (DFT), discrete cosine transform (DCT), modified discrete cosine transform (MDCT) or the like. The MDCT is further described in the publication "Subband/Transform Coding Using Filter Bank Designs Based on Time Domain Aliasing Cancellation" (J. P. Princen, A. B. Bradley, Univ. of Surrey Royal Melbourne Inst. of Tech. ICASSP, 1987).

When the DFT or DCT is used for spectrum transform of a waveform signal, M pieces of independent real data can be acquired by transforming the waveform signal in time blocks each of M pieces of sample data (will be referred to as "transform block" hereinafter). Normally, for reduction of the distortion of connection between transform blocks, 1M pieces of sample data of one of transform blocks next to each other are arranged to overlap 1M pieces of sample data of the other transform block. Thus, the DFT or DCT will be able to provide M pieces of real data from a mean number (M–M1) of sample data. Therefore, the M pieces of real sample data will subsequently be quantized and coded.

On the other hand, when the MDCT is used for spectrum transform, M pieces of independent real data can be acquired from 2M pieces of samples of which M pieces at ends of adjoining transform blocks, opposite to each other, are arranged to overlap each other. More specifically, when the MDCT is employed for the spectrum transform, M pieces of read data can be acquired from a mean number M of sample data, and the M pieces of real data will subsequently be quantized and coded. In the decoder, waveform elements acquired from codes acquired using the MDCT by making an inverse transform in each block are added together while being in interference with each other to reconstruct a waveform signal.

Generally, when a transform block intended for spectrum transform is made longer, the frequency resolution will be higher and the energy will concentrate to a certain spectrum signal component. Therefore, by making a spectrum transform with a large length of adjoining transform blocks, a half of sample data in one transform block being laid to overlap a half of sample data in the other transform block, and using the MDCT in such a manner that the number of spectrum signal components thus acquired will not be larger than the number of sample data on an original time base, it is possible to code an audio signal with a higher efficiency than when the DFT or DCT is used for the same purpose. Also, by arranging adjoining transform blocks to overlap each other over a sufficiently large length thereof, it is possible to reduce the distortion of connection between transform blocks of a waveform signal. However, since the long transform blocks will lead to a necessity of more work areas for transforming, the increased length of transform blocks will be a problem to a more compact design of the reading means, etc. Especially, the longer transform blocks will lead to an increase of manufacturing costs when it is difficult to raise the degree of semiconductor integration.

As mentioned above, quantization of signal components divided into subbands by the filtration and spectrum transform makes it possible to control any band where a quantum noise takes place. Therefore, using the so-called masking effect, a high auditory efficiency can be attained.

The above-mentioned "masking effect" refers to a phenomenon that a loud sound will acoustically cancel a low one. With this effect, it is possible to acoustically conceal a quantum noise behind an original signal sound. Thus, even with the signal sound compressed, a sound quality almost the same as that of the original signal can be provided in hearing a reproduced sound. In order to utilize the masking effect effectively, however, it is essential to control the occurrence of the quantum noise in the time and frequency domains. For example, when a signal including an attacking part of which the signal level abruptly becomes high next to a low signal level is blocked for coding and decoding, a quantum noise occurring due to the coding and decoding of the signal block including the attacking part will also appear in the low-level signal part before the attacking part. For example, if the duration of the low-level signal part before the attacking part is short, the low-level signal part will acoustically be concealed under the masking effect of the attacking part. For example, however, if the low-level signal part before the attacking part lasts for more than a few milliseconds in a signal block, it will be beyond the range of the masking effect of the attacking part, so that the low-level signal part will not acoustically be concealed. Then, a sound quality degradation known as "pre-echo" will take place, causing the sound signal to be unpleasant to hear. In this event, the length of a block for transform to a spectrum signal is changed depending upon the property of the signal in the block to prevent pre-echo from taking place, as the case may be. Note that by normalizing each sample data with the maximum one of the absolute values of signal components in each of the subbands before quantizing it, a higher efficiency of code can be attained.

Also, a bandwidth suitable for the human auditory characteristics for example should preferably be used as a frequency division width for quantization of each signal component acquired by dividing the frequency band of an audio signal for example. That is, the audio signal should preferably be divided into a plurality of subbands (25 bands) each having a bandwidth which is wider as the band frequency is higher and generally called "critical band". For coding data of each subband at this time, a predetermined bit distribution is effected for each subband or an adaptive bit allocation is done for each subband. For example, to code a factor data acquired by the MDCT using the above-mentioned adaptive bit allocation, an MDCT factor data for each subband, acquired by the MDCT for each transform block is coded with an adaptive number of allocated bits. The bit allocation is effected by any of the two methods which will be described below.

One method is disclosed in the publication "Adaptive Transform Coding of Speech Signals" (R. Zelinski and P. Noll, IEEE Transactions of Acoustics, Speech and Signal Processing, Vol. ASSP-25, No. 4, August, 1977). In this method, the bit allocation is done based on the size of a signal of each subband. The quantum noise spectrum is flat and the noise energy is minimum. However, since no acoustic masking effect is utilized in this method, the actual noise thus suppressed is not optimal.

The other method is described in the publication "The Critical Band Coder—Digital Encoding of the Perceptual Requirements of the Auditory System" (M. A. Kransner, MIT, ICASSP, 1980). This method uses the acoustic masking to acquire a necessary signal to noise ratio for each subband and make a fixed bit allocation. Since the bit allocation is a fixed one, however, a sound characteristic measured with a sine wave input will not be so good.

To solve the above problems, a highly efficient coding has been proposed in which all bits usable for the bit allocation are divided into two groups for a fixed bit application pattern predetermined for each small block and a bit distribution depending upon the number of bits in each block, respectively, at a division ratio being dependent upon a signal related to an input signal, and the number of the bits for the fixed bit application pattern is increased as the pattern of the signal spectrum is smoother.

If the energy concentrates to a certain spectrum signal component as in a sine wave input, the overall signal to noise ratio can remarkably be improved by this method by allocating more bits to a block including that spectrum signal component. Generally, since the human auditory sense is extremely keen to a signal having a steep spectrum signal component, the improvement of the signal to noise ratio characteristic by this method will not lead only to a better measured S/N value but also to an improved sound quality.

Many other bit allocation methods have been proposed. If a more elaborately designed auditory sense model is available and the encoder's ability allows, a more highly efficient coding is possible.

Generally, in these methods, a real reference value for the bit allocation is determined which realizes a signal to noise ratio determined by calculation with a fidelity as high as possible, and an integral value approximate to the reference value is taken as a number of allocated bits.

For actual code string configuration, first, quantizing accuracy information and normalization factor information should be coded with a predetermined number of bits for each subband to be normalized and quantized, and then normalized and quantized spectrum signal components should be coded. The ISO standard (ISO/IEC 11172-3:1993 (E), 1993) prescribes a highly efficient coding method in which the number of bits indicative of quantizing accuracy information is set different from one subband to another and the number of bits representing the quantizing accuracy information is set smaller for subbands of higher frequencies.

Instead of directly coding the quantizing accuracy information, quantizing accuracy information may be determined from normalization factor information, for example, in the decoder. However, this method will not be compatible with a control of the quantizing accuracy based on a more highly sophisticated auditory sense model which will be introduced in the future, since the relation between the normalization factor information and quantizing accuracy information is determined when the standard is set. Also when a compression rate has to be determined in a certain range, it is necessary to determine the relation between the normalization factor information and quantizing accuracy information for each compression rate.

Also, a method for efficiently coding quantized spectrum signal components via coding using a variable-length code is known from the disclosure in the publication "A Method for Construction of Mnimum Redundancy Codes" (D. A Huffman, Proc. 1. R. E., 40, p. 1098, 1952).

Further, there has been proposed in the specification and drawings of the international publication No. W094/28633 of the Applicant's international patent application an audio signal coding method in which an acoustically most important tone component is separated from spectrum signal components and then coded separately from other spectrum signal components. By this method, an audio signal or the like can be coded efficiently with a high compression rate without little degradation of the sound quality.

Note that each of the aforementioned coding methods is applicable to each channel of an acoustic signal composed of a plurality of channels. For example, by applying the method to each of an L channel corresponding to a left-hand speaker and R channel corresponding to a right-hand speaker, a stereo audio signal can be coded with a high efficiency. Also, the coding method may be applied to a (L+R)/2 signal acquired by adding together signals of the L and R channels. Further, of the signals of the same two channels, a (L+R)/2 signal and (L-R)/2 signal may be coded efficiently by the above method. Furthermore, the Applicant of the present invention suggested, in the specification and drawings of the Japanese Patent Application No. 97-81208, a signal coding method in which the band of the (L−R)/2 signal is made narrower than the (L+R)/2 signal to code an audio signal efficiently with a smaller number of bits while maintaining a stereophony of the reproduced audio sound in hearing. This method is based on the fact that the stereophony of a sound is predominantly influenced by a low frequency portion of the sound.

As in the above, methods for code with higher efficiency have been developed one after another. By adopting a standard covering a newly developed method, it is possible to record data for a longer time and record an audio signal with a higher quality than ever for the same length of recording time.

To map a time-series audio signal in the time and frequency domains for coding the signal, a highly efficient coding method has been proposed which is a combination of the previously described subband coding and transform coding. In this method, after the frequency band of an audio signal is divided into subbands by the subband coding for example, the signal of each subband is transformed in spectrum to a signal on the frequency base and each of the subbands thus spectrum-transformed is coded.

The coding by the division of signal frequency band by the subband filter, followed by the transform to spectrum signal by the MDCT or the like is advantageous as will be described below:

First, since the transform block length and the like can be set to an optimum for each subband, the occurrence of the quantum noise in the time and frequency domains can optimally be controlled for hearing to improve the sound quality.

Generally, the spectrum transform by the MDCT is effected using a high speed computation such as fast Fourier Transform (FFT) in many cases. For such a high speed computation, however, a memory area having a size proportional to the length of a block is required. However, since the number of samples for spectrum transform can be reduced for the same frequency resolution by transforming the spectrum of signals once divided into subbands and then thinned proportionally to the bandwidth for each subband, it is possible to reduce the memory area necessary for the spectrum transform.

Further, when a coded signal for example is decoded, it does not have a high sound quality. Reproduction of an audio signal by a decoder having a hardware scale as small as possible can be attained by processing only the signal data of low frequencies. Thus, this method is very convenient and usable.

Since the compression method using a method for transforming the spectrum signal by a combination of a subband filter and spectrum transform by the MDCT can be implemented by a relatively small-scale hardware, it is very convenient as a compression method for a portable recorder for example. However, since many product-sum calculations are required for implementation of the subband filter, the operations will be increased for the computation.

For acquisition of a read signal by decoding a coded signal as in the above, it is required in a computer game machine, editing equipment and other equipment for example as the case may be to decode a coded signal for example while transforming the pitch of the signal.

For reproduction of a sound higher one octave for example than an original audio signal actually coded, coded signals of all frequency bands have to be decoded at a two times higher speed. For reproduction of a two octaves higher sound, coded signals of all frequency bands have to be decoded at four times higher speed. Therefore, for acquisition of a louder sound than an original sound using the pitch shifting method, it is necessary to design the processing speed and amount of the decoder sufficiently high correspondingly to the sound pitch, which results in increased manufacturing costs of the decoder.

SUMMARY OF THE INVENTION

It is therefore an object of the present invention to overcome the above-mentioned drawbacks of the prior art by providing a signal processing method and apparatus, capable of reproducing a coded audio signal by decoding it while shifting its pitch, and reproducing, from an original sound, a sound having a desired sufficiently higher pitch than the original sound with [not many] reduced operations and with decreased costs for the decoder used in the signal processing apparatus, and an information serving medium for serving a program which implements the signal decoding and pitch shifting.

The above object can be attained in one embodiment consistent with the present invention, by providing a signal processing method for decoding a coded signal for reading, including, setting a pitch for a decoded read signal; decoding only a low frequency portion of the coded signal according to the set pitch; and shifting the pitch of the decoded read signal based on the set pitch.

The above object can also be attained in another embodiment consistent with the present invention by providing an information processing method for decoding a coded signal for reading, including, setting a pitch for a decoded read signal; decoding the coded signal with zero inserted at a high frequency portion, corresponding to the set pitch, of the coded signal; and generating a read signal having a pitch corresponding to the set pitch.

The above object can also be attained in another embodiment consistent with the present invention, by providing a signal processing apparatus for decoding a coded signal for reading, including, means for setting a pitch for a decoded read signal; means for decoding only a low frequency portion of the coded signal according to the set pitch; and means for transforming the pitch of the decoded read signal based on the set pitch.

The above object can also be attained in another embodiment consistent with the present invention, by providing a signal processing apparatus for decoding a coded signal for reading, including, means for setting a pitch for a decoded read signal; means for decoding the coded signal with zero inserted at a high frequency of the coded signal according to the set pitch; and means for generating a read signal having a pitch corresponding to the set pitch.

In the above signal processing methods and apparatuses according to another embodiment consistent with the present invention, when the coded signal is one acquired by dividing the frequency band of a signal, only the subband of a low frequency portion of the signal whose frequency band has been divided into subbands is decoded according to the set pitch. When the coded signal is one acquired by transforming a signal to frequency components and then coding it, only the low frequency one of the transformed frequency components is decoded according to the set pitch. Also in the signal processing methods and apparatuses according to one embodiment consistent with the present invention, the digital read signal whose pitch has been shifted according to the set pitch is converted to an analog read signal with a clock corresponding to the set pitch. Further, during the pitch shifting, a sampling-transformation can be done by sampling-transforming only the low frequency portion of the decoded read signal which can be sample-transformed according to the set pitch or with zero inserted at the high frequency portion of the decoded read signal. Thus, a sound having a desired sufficiently higher pitch than an original sound can be reproduced from the original sound with not many operations and with no increase of the manufacturing costs. And, a sound whose pitch has been shifted can be produced without any aliasing.

The above object can also be attained in another embodiment consistent with the present invention, by providing an information serving medium for serving a program according to which a coded signal is decoded and read, the program including, setting a pitch for a decoded read signal; decoding only a low frequency portion of the coded signal according to the set pitch; and shifting the pitch of the decoded read signal based on the set pitch.

The above object can also be attained in another embodiment consistent with the present invention, by providing an information serving medium for serving a program under which a coded signal is decoded and read, the program including, setting a pitch for a decoded read signal; decoding the coded signal with zero inserted at a high frequency portion of the coded signal according to the set pitch; and generating a read signal having a pitch corresponding to the set pitch.

With the above-mentioned information serving media according to the above mentioned embodiment consistent with the present invention, a sound having a desired sufficiently higher pitch than an original sound can be reproduced from the original sound with not many operations and with no increase of the manufacturing costs.

These objects and other objects, features and advantages of the present intention will become more apparent from the following detailed description of the preferred embodiments of the present invention when taken in conjunction with the accompanying drawings.

DETAILED DESCRIPTION OF THE PREFERRED EMBODIMENTS

The signal processing method and apparatus according to the present invention is suitable for use in computer game machines, editing equipment and other electronic equipment, for example, to reproduce a coded signal by decoding it while shifting its pitch. Prior to describing the decoding of the coded signal and shifting its pitch, there will first be described the architecture for generating a coded signal which is handled in the signal processing method and apparatus according to the present invention. Note that each of the components which will be described herebelow may be regarded as either hardware or software.

The embodiments of the present invention adopt the aforementioned highly efficient coding techniques for generation of a coded signal. As one of the highly efficient coding techniques, a technique for coding an input digital signal such as audio PCM signal by the subband coding (SBC), adaptive transform coding (ATC) and adaptive bit allocation, will be described herebelow with reference to FIGS. 1 to 5.

Figure 1:
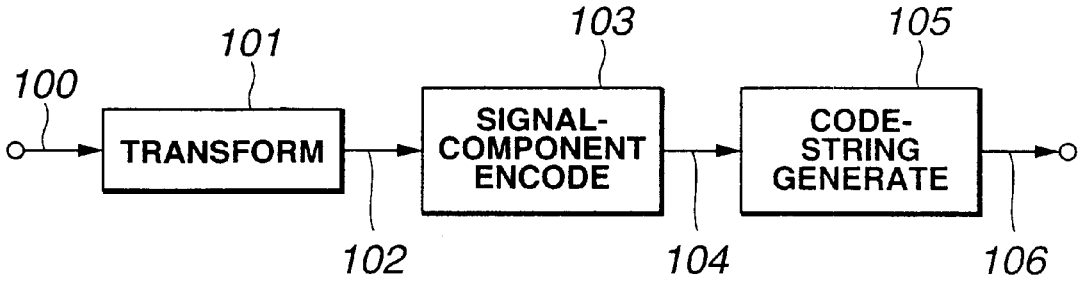
FIG. 1 is a schematic block diagram of the encoder according to the present invention.

Referring now to FIG. 1, there is generally illustrated in the form of a block diagram the encoder according to the present invention to code an audio PCM signal (sound waveform signal). As shown, the encoder includes a transformer 101 to transform an input audio PCM signal (sound waveform signal) 100 to signal frequency components 102, a signal component encoder 103 to code each frequency component, and a code string generator 105 to produce a code string 106 from a coded signal 104 produced by the signal component encoder 103.

Figure 2:
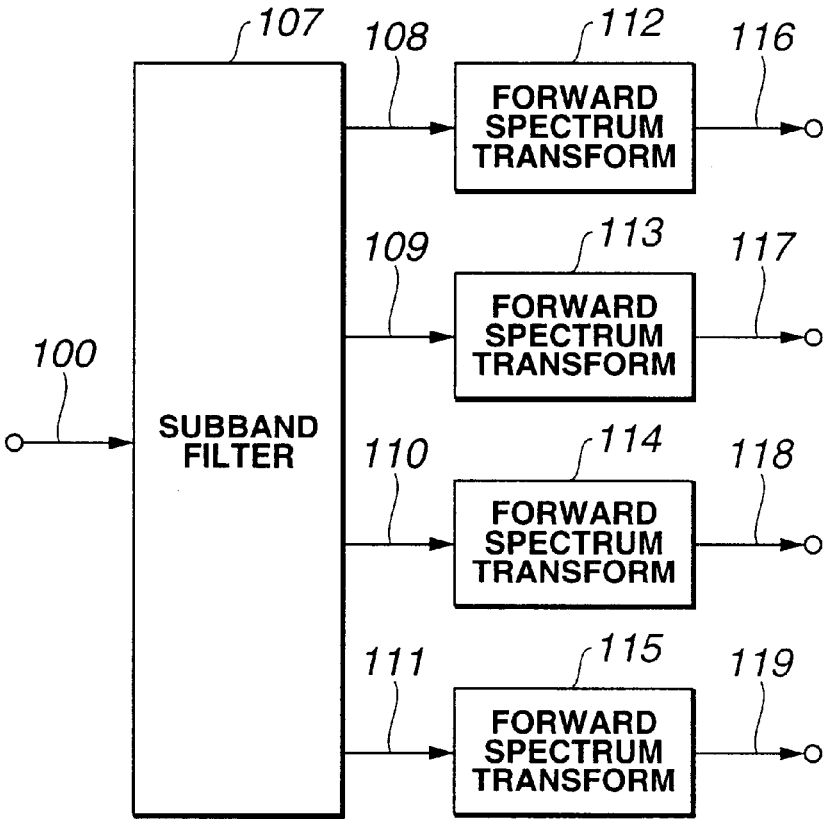
FIG. 2 is a block diagram of the transformer provided in the encoder in FIG. 1.

FIG. 2 shows a construction example of the transformer 101 provided in the encoder in FIG. 1. As shown the transformer 101 includes a subband filter 107 and forward spectrum transformers 112, 113, 114 and 115 each using a MDCT or the like. The input signal 100 to the transformer 101 is divided by the subband filter 107 into a plurality of frequency bands (four in the example shown in FIG. 2). The signals 108, 109, 110 and 111 of the frequency bands thus obtained are transformed by the forward spectrum transformers 112, 113, 114 and 115 into spectrum signal components 116, 117, 118 and 119. Note that the input signal 100 corresponds to the audio PCM signal (sound waveform signal) in FIG. 1 and the spectrum signal components 116 to 119 correspond to the signal frequency components 102 in FIG. 1. In the transformer 101 constructed as shown in FIG. 2, the bandwidth of the four signals 108 to 111 is a quarter of that of the input signal 100. That is, the input signal 100 is reduced to the quarter by the transformer 101. Of course, the transformer 101 may be any other than shown here. For example, the input signal may be transformed directly to spectrum signals by the MDCT, and DFT or DCT may be used in place of the MDCT itself for this purpose. Note that the embodiment of the present invention will be described herebelow on the assumption that a frequency band of an audio signal ranging from 0 to 24 kHz for example is divided by the subband filter 107 into four frequency bands of 0 to 6 kHz, 6 to 12 kHz, 12 to 18 kHz and of 18 to 24 kHz, respectively.

Figure 3:
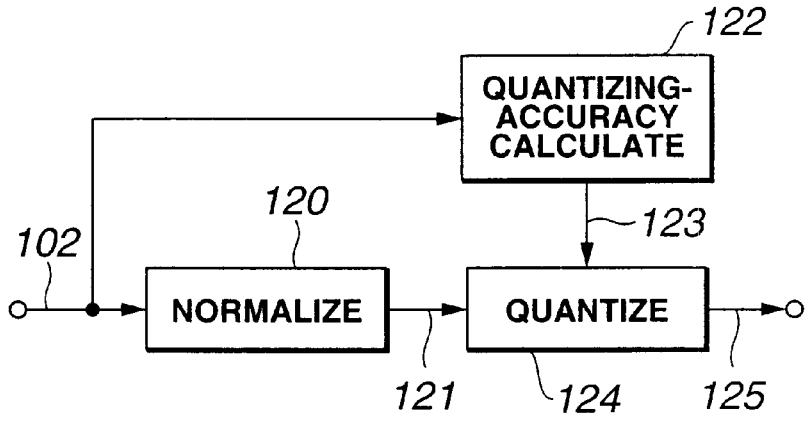
FIG. 3 is a block diagram of the signal component encoder provided in the encoder in FIG. 1.

FIG. 3 shows a construction example of the signal component encoder 103 provided in the encoder in FIG. 1. As shown, the signal component encoder 103 includes a normalizer 120 to normalize each signal component 102 at every predetermined band, a quantizing accuracy calculator 122 to determine a quantizing accuracy information 123 from the signal components 102, and a quantizer 124 to quantize a normalized spectrum factor data 121 supplied from the normalizer 120 based on the quantizing accuracy information 123. Note that the signal components 102 correspond to the signal frequency components 102 in FIG. 1 and the coded signal 104 in FIG. 1 includes, in addition to a quantized signal component 125 from the quantizer 124 in FIG. 3, a normalization factor information used in the normalization and the above-mentioned quantizing accuracy information 123.

Figure 4:
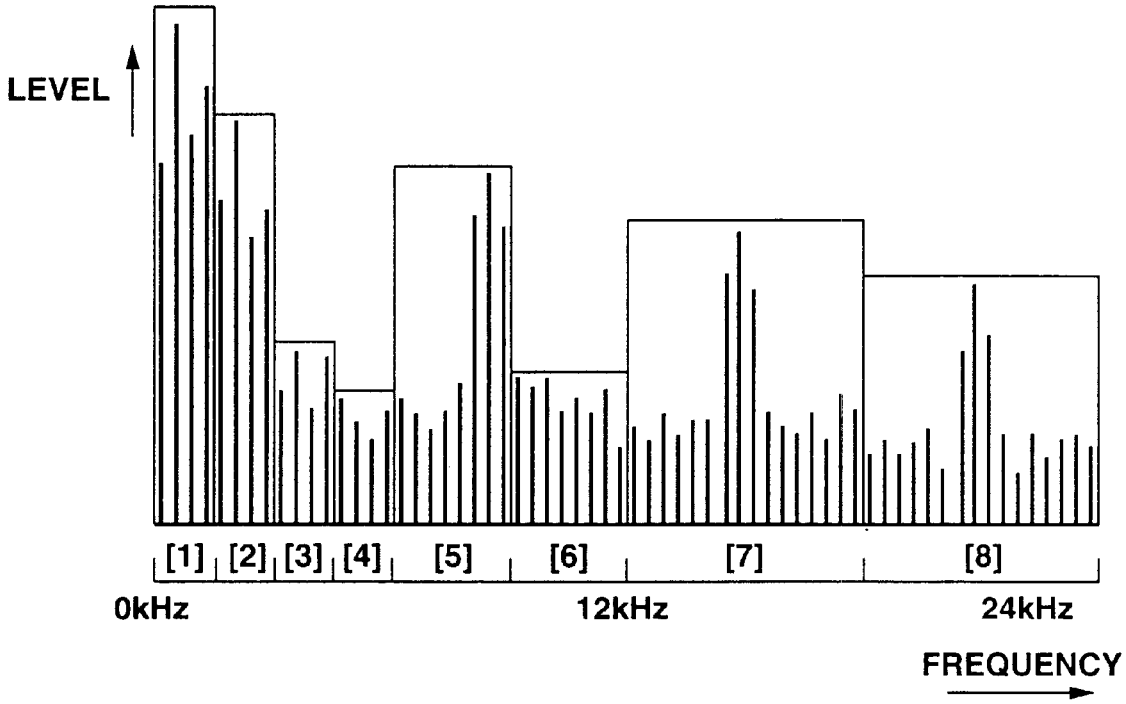
FIG. 4 explains the coded units.

The spectrum signals provided from the transformer 101 in the encoder in FIG. 1 are as shown in FIG. 4. FIG. 4 explains the coded units. Each spectrum signal shown in FIG. 4 is a result of the transformation into decibels (dB) of the absolute value level of each of the spectrum components generated by the MDCT. In the encoder, an input signal is transformed into sixty four spectrum signals at every predetermined transformation block, and the spectrum signals are grouped into eight frequency bands (1) to (8) (will be referred to as "coded units" hereinafter) in FIG. 4 for normalization and quantization. Also, by changing the quantizing accuracy at every coded unit depending upon how the frequency components are distributed, it is possible to code the signal with a minimum possible degradation in sound quality of the signal in hearing the sound and thus a sound with a high hearing efficiency can be reproduced.

Figure 5:
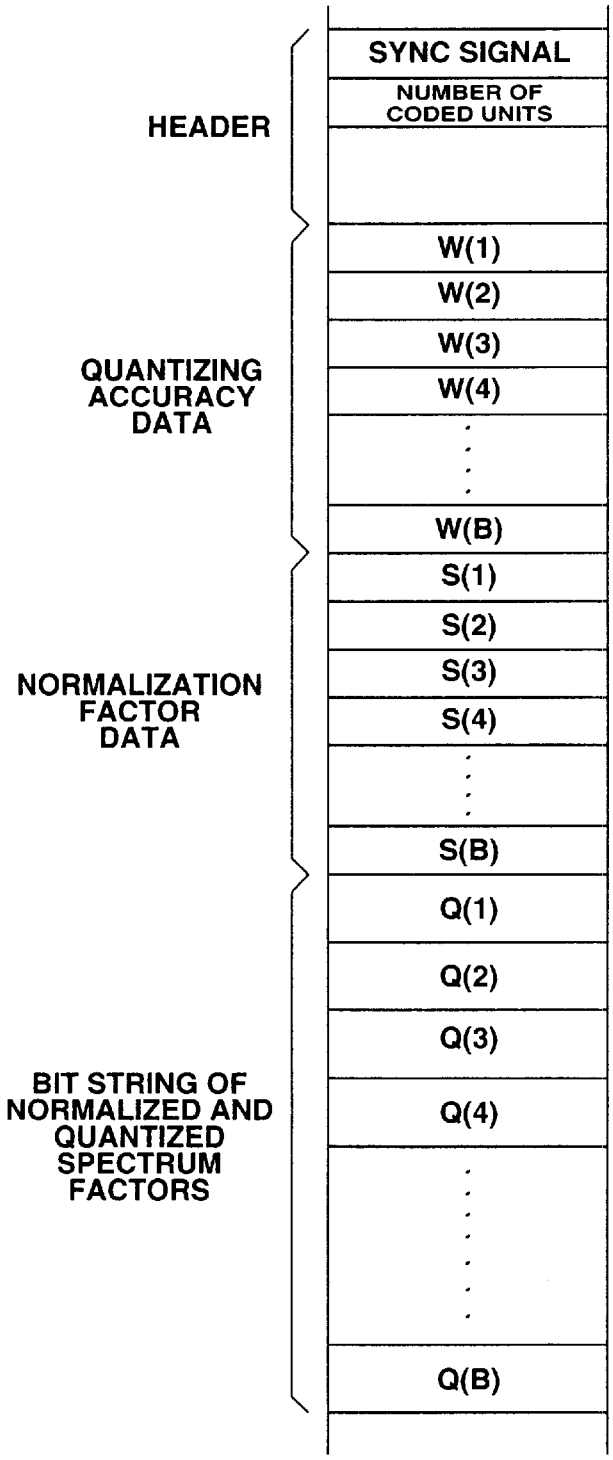
FIG. 5 explains the code string.

FIG. 5 explains the code string, showing a construction example of the code string generated by the code string generator 105 in the encoder in FIG. 1. As shown, the code string is composed of data destined for restoration of the spectrum signal in each transform block (time block) and which are coded correspondingly to a frame formed from a predetermined number of bits. The top (header) of each frame includes information resulted from coding of control data with a fixed number of bits, such as a sync signal and number of coded units. The header is followed by information resulted from sequential coding of quantizing accuracy information and normalization factor information of each coded unit, starting with the lowest-frequency coded unit. Finally, the normalization factor information is followed by information resulted from sequential coding of the normalized and quantized spectrum factor data at each coded unit and based on the above normalization factor information and quantizing accuracy information, starting with the lowest-frequency coded unit. The actual number of bits, required for restoration of the spectrum signal of these transform blocks (time blocks), depends upon the number of coded units and number of quantized bits the quantizing accuracy information of each coded unit indicates, and it may vary from one frame to another.

Note that the aforementioned coding method can further be improved in coding efficiency.

The coding efficiency can be improved by assigning a relatively short code length to ones, appearing frequently, of the quantized spectrum signals and a relatively long code length to less frequently appearing ones, for example. This technique is the so-called variable-length coding.

Also, by increasing the length of the predetermined transform block for coding the input signal, namely, the time block for the spectrum transform, for example, it is possible to relatively reduce the amount/block of sub information such as the quantizing accuracy information and normalization factor information, and the frequency resolution can also be increased so that the quantizing accuracy can be controlled more elaborately along the frequency axis. Thus the coding frequency can be improved.

Further, as having been proposed in the international publication No. W094/28633 of the specification of the Applicant's international patent application for example, an audio signal can be coded efficiently with a high compression ratio with little degradation in sound quality of the audio signal in hearing the sound by separating a tone component, especially important in hearing, of spectrum signal components, that is, a signal component having a certain frequency to around which the energy concentrates, and coding the tone component separately from other spectrum signal components.

Next, there will be described herebelow the embodiments of the signal processing method and apparatus according to the present invention, in which an audio signal is reproduced by decoding the code string generated by the aforementioned encoder and shifting the pitch.

For the pitch shift (to the higher frequency band) by which an audio signal is reproduced by decoding the code string while shifting the sound pitch towards the higher frequency, it is assumed herein that a signal sampled with a frequency of 48 kHz for example is reproduced by shifting the sound pitch to a two octaves higher (namely, four times) one. Also as having been described in the foregoing, it is assumed that for coding, the frequency band of an audio signal ranging from 0 to 24 kHz is divided into four bands of 0 to 6 kHz, 6 to 12 kHz, 12 to 18 kHz, and of 18 to 24 kHz, respectively.

Of the four frequency bands, the signal components of the original audio signal each having a higher frequency than 6 kHz will be transformed to signal components each having a higher frequency than 24 kHz by shifting the sound pitch by the two octaves (four times). However, with a signal having a frequency band of more than 20 kHz, the human ears cannot normally perceive (the frequency is defined herein as more than 24 kHz because of the difference in hearing ability from one person to another) nor will show any degradation in sound quality even when it is not reproduced as in the above). Namely, it is considered that when the sound pitch is shifted by two octaves (four times), the signal components of the original audio signal, falling within a frequency band of higher than 6 kHz, do not have to be reproduced. Also when an audio signal whose pitch has been shifted to a higher one is re-sampled with a frequency of 48 kHz, the signal components of a frequency higher than 24 kHz has to be previously removed in order to avoid any influence of the aliasing. Therefore, when the pitch of an audio signal is shifted to a higher one, no actual degradation in sound quality will actually result even if the decoding and reproduction of the higher frequency components of the signal are omitted in advance.

Similarly, it is assumed here that an audio signal sampled with a frequency of 48 kHz for example is reproduced by shifting its pitch to a one octave (namely, two times) higher one. In this case, since the signal components of the original audio signal included in the above four bands and which have a frequency of higher than 12 kHz will be transformed to signal components having a frequency higher than 24 kHz by shifting the pitch by one octave (two times), it is not necessary to reproduce the signal components of the original audio signal having a frequency of higher than 12 kHz. Also in this case, when the pitch-shifted signal is re-sampled with 48 kHz, it is necessary to remove the signal components having a frequency higher than 24 kHz in advance in order to prevent any influence of the aliasing.

Thus, the first embodiment of the decoder according to the present invention is adapted such that when an original audio signal is reproduced by decoding its code string while shifting the sound pitch to a higher one (towards a higher frequency), the pitch-shifted signal is reproduced rapidly by a relatively small-scale hardware by decoding only the low frequency components of the original audio signal.

Figure 6:
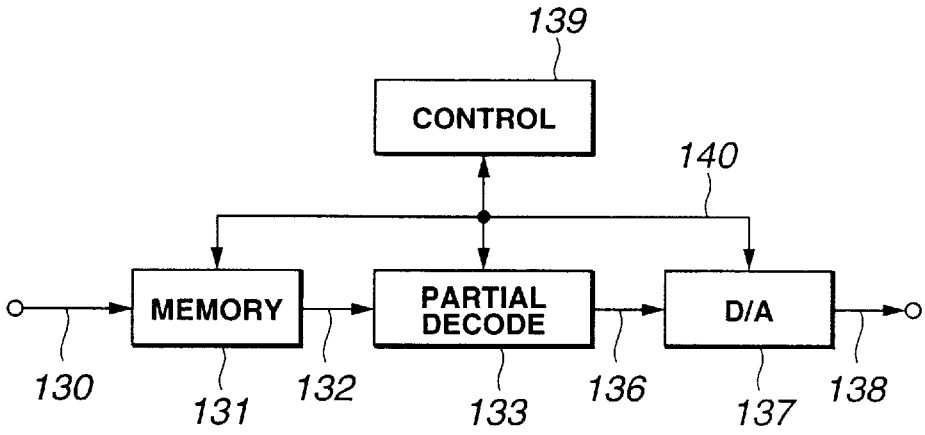
FIG. 6 is a schematic block diagram of a first embodiment of the pitch-shifting decoder according to the present invention.

Referring now to FIG. 6, there is schematically illustrated in the form of a block diagram the first embodiment of the decoder (audio signal decoding decoder) according to the present invention. As shown, this decoder includes a memory 131, partial decoder 133, digital/analog (D/A) converter 137 and a controller 139. A coded audio signal is stored in the memory 131. The original audio signal is reproduced by the decoder by shifting the pitch of the coded signal from the memory 131.

In FIG. 6, an input signal 130 to the decoder is the code string (coded data) generated by compressing coding by the encoder of an audio PCM signal sampled with 48 kHz as mentioned above, shown in FIG. 5. The input signal 130 is stored once in the memory 131.

The memory 131 is a semiconductor memory for example. Data write to and read from the memory 131 can be done at an arbitrary speed according to a control signal 140 from the controller 139. Also, the memory 131 can provide the same data part of an audio signal repeatedly and only a part of the stored coded data can be read from the memory 131. A coded data 132 read from the memory 131 is sent to the partial decoder 133.

The partial decoder 133 is provided to extract only the coded data in desired low frequency bands from the code string in FIG. 5 based on a control signal 140 generated by the controller 139 according to a pitch select signal designated by the user and decode only the coded data in the low frequency bands. The coded data in the desired low frequency bands are coded data in a frequency band of lower than 6 kHz of an original audio signal when a signal sampled with 48 kHz as in the above is reproduced by shifting its pitch to a two octaves (4 times) higher one for example, or a coded data in a frequency band of lower than 12 kHz of the original audio signal when the signal sampled with 48 kHz is reproduced by shifting its pitch to a one octave (two times) higher one. Since only the coded data in the desired low frequency bands are extracted for decoding, the partial decoder 133 can decode at a higher speed with not many operations than in the signal reproduction with decoding of code data included in all the frequency bands and shifting their pitches. In the above, it was described that code strings in all the frequency bands are read from the memory 131 and the partial decoder 133 extracts, for decoding, only coded data in desired low frequency bands from the code strings in all the frequency bands. However, only coded data in desired low frequency bands may be read when coded data are read from the memory 131 and sent to the partial decoder 133. Also, in the above, the operations for pitch shift to a higher frequency was described. However, when no pitch shift to a higher frequency band is effected, the partial decoder 133 will decode coded data in all frequency bands. The partial decoder 133 decodes at a speed corresponding to a pitch shifting. For example, when the pitch is shifted to a two octaves higher frequency band, the decoding is done at a four times higher speed. When the pitch shift is made to a one octave higher band, the decoding will be made at a two times higher speed. A time-series audio data 136 thus processed is sent to the D/A converter 137.

The D/A converter 137 converts to an analog signal 138 the audio data 136 having been decoded by the partial decoder 133 at a speed corresponding to a pitch shift. Note that when the data whose pitch has been shifted is subjected directly to the D/A conversion as in this embodiment, the D/A conversion uses a clock whose rate corresponds to the pitch. For example, when an original audio signal sampled with a frequency of 48 kHz for example is reproduced by shifting its pitch to a one octave higher one, a clock corresponding to a sampling frequency of 96 kHz will be used in the D/A conversion.

Figure 7:
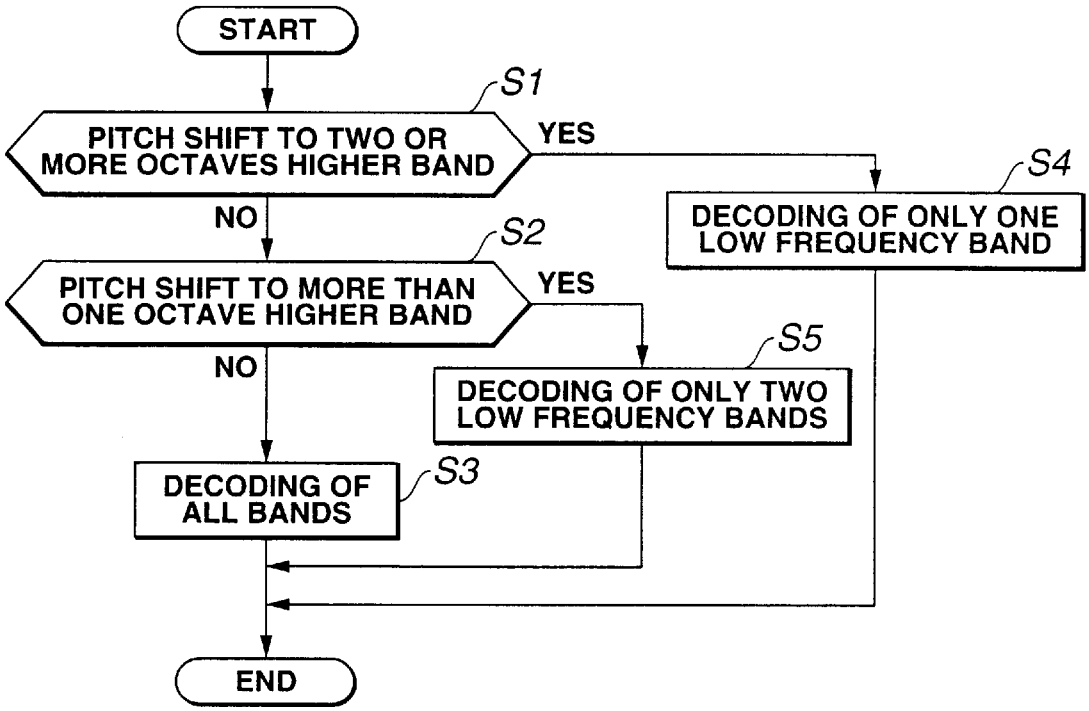
FIG. 7 is a flow chart of basic operations effected for signal decoding and reproduction with the pitch shifting in the decoder in FIG. 6.

FIG. 7 is a flow chart of basic operations effected by the controller 139 in controlling all the component units of the decoder in the aforementioned pitch shifting as in FIG. 6.

As in FIG. 7, the controller 139 judges first at step S1 whether or not the pitch is to be shifted to a two octaves higher band. When the judgment result is Yes (the pitch is to be shifted to the two octaves higher hand), the controller 139 goes to step S4. If the judgment result is NO, the controller 139 will go to step S2.

At step S4, the controller 139 controls the memory 131, partial decoder 133 and D/A converter 137 to make operations necessary for a pitch shift to a more than two octaves higher band. More specifically, the controller 139 controls the memory 131 and partial decoder 133 to make operations for decoding a coded data in one low frequency band (one lowest frequency band) of the aforementioned four subbands at a more than 4 times higher speed for the pitch shifting, and controls the D/A converter 137 to make a D/A conversion of the sound having a more than two octaves higher frequency with a clock for the more than two octaves higher pitch.

At step S2, the controller 139 judges whether or not the pitch is to be shifted to a more than one octave higher band. If the judgment result is YES, the controller 139 goes to step S5. When the judgment result is NO, the controller 139 will go to step S3.

At step S5, the controller 139 controls the memory 131, partial decoder 133 and D/A converter 137 to make necessary operations for shifting the pitch to a more than one octave higher band. More specifically, the controller 139 controls the memory 131 and partial decoder 133 to made operations for decoding coded data in two low frequency bands at a more than two times higher speed for the pitch shifting, and the D/A converter 137 to make a D/A conversion of the sound having a more than one octave higher frequency with a clock for the more than one octave higher pitch.

On the other hand, at step S3, the controller 139 controls the memory 131, partial decoder 133 and D/A converter 137 to make necessary operations for decoding coded data in all frequency bands. Namely, the controller 139 controls the memory 131 and partial decoder 133 to make operations for decoding the coded data in all the frequency bands at a speed for the pitch shifting, and the D/A converter 137 to make a D/A conversion of the sound with a clock for the pitch shifting.

Figure 8:
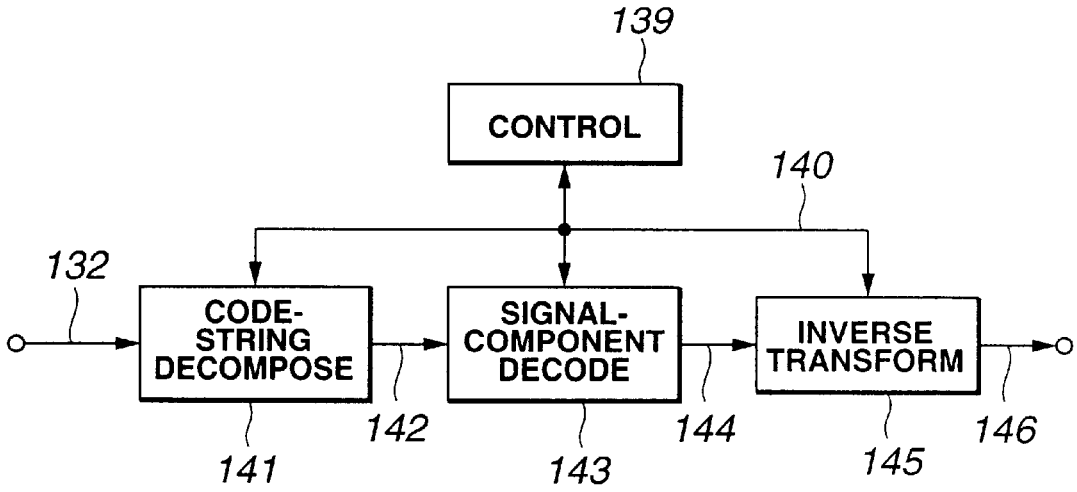
FIG. 8 is a schematic block diagram of the partial decoder provided in the decoder in FIG. 6.

FIG. 8 shows in detail the construction of the partial decoder 138 and the controller 139 provided in the decoder in FIG. 6.

As shown, the partial decoder 138 includes a code string decomposer 141, signal component decoder 143 and an inverse transformer 145. The code string decomposer 141 extracts from an input code string 132 (corresponding to the coded data 132 in FIG. 6) a code of each signal component, normalization factor information and quantizing accuracy information. More particularly, for the pitch shifting as in the above, the code string decomposer 141 extracts, based on the control signal 140 from the controller 139, a code of a desired signal component, normalization factor information and quantizing accuracy information, corresponding to the pitch shift, from the code string shown in FIG. 5. An output signal 142 from the code string decomposer 141 is sent to the signal component decoder 143.

The signal component decoder 143 restores each signal component 144 from the signal 142. More specifically, for the pitch shifting as in the foregoing, the signal component decoder 143 dequantizes and de-normalizes the code of the signal component supplied from the code string decomposer 141 according to the control signal 140 from the controller 139, thereby providing a signal component 144. The signal component 144 restored by the dequantization and de-normalization in the signal component decoder 143 is sent to the inverse transformer 145.

The inverse transformer 145 makes an inverse spectrum transformation of the signal component 144 from the signal component decoder 143, and synthesizes a sound waveform signal 146 from the frequency bands. Note that the sound waveform signal 146 corresponds to the time-series audio data 136 in FIG. 6.

Figure 9:
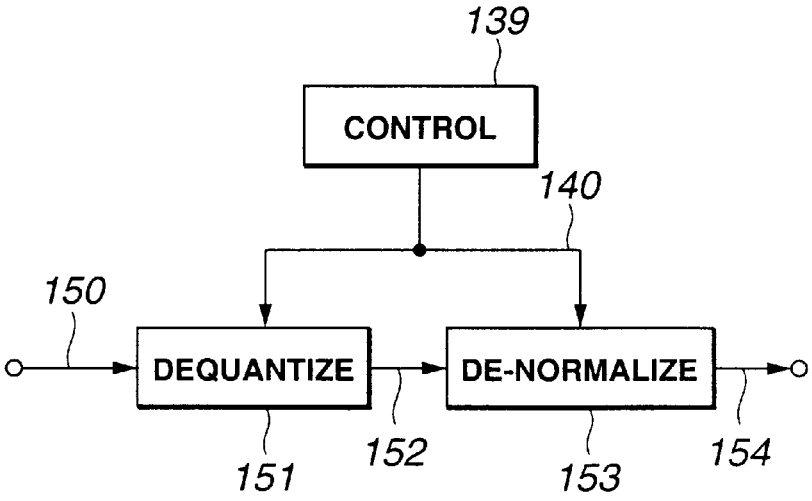
FIG. 9 is a block diagram of the signal component decoder provided in the partial decoder in FIG. 8.

FIG. 9 shows in detail the construction of the signal component decoder 143 provided in the partial decoder in FIG. 8.

As shown in FIG. 9, the signal component decoder 143 includes an inverse dequantizer 151 and inverse de-normalizer 153. Using the quantizing accuracy information, the inverse dequantizer 151 dequantizes the code of the signal component of an input signal 150 from the code string decomposer 141 in FIG. 8 according to the control signal 140 from the controller 139. More particularly, for the pitch shifting as in the above, the inverse dequantizer 151 uses the quantizing accuracy information in the desired band extracted correspondingly to the pitch shift to dequantize the code of the signal component in the desired band extracted correspondingly to the pitch shift by the code string decomposer 141, thereby providing a signal component 152. The dequantized signal component 152 is sent to the de-normalizer 153. Note that the signal 150 in FIG. 9 corresponds to the signal 142 in FIG. 8.

According to the control signal 140 from the controller 139, the de-normalizer 153 de-normalizes the dequantized signal 152 using the normalization factor information to provide a signal component 154. More specifically, for the pitch shifting as in the above, the de-normalizer 153 uses the normalization factor information in the desired band extracted by the code string decomposer 141 correspondingly to the pitch shift to de-normalize the signal 152 having been dequantized by the dequantizer 151, thereby providing a signal 154. Note that this signal 154 in FIG. 9 corresponds to the signal 144 in FIG. 8.

The signal component decoder 143 in FIG. 9 is adapted to decode at a high speed with not many operations for the pitch shifting.

Figure 10:
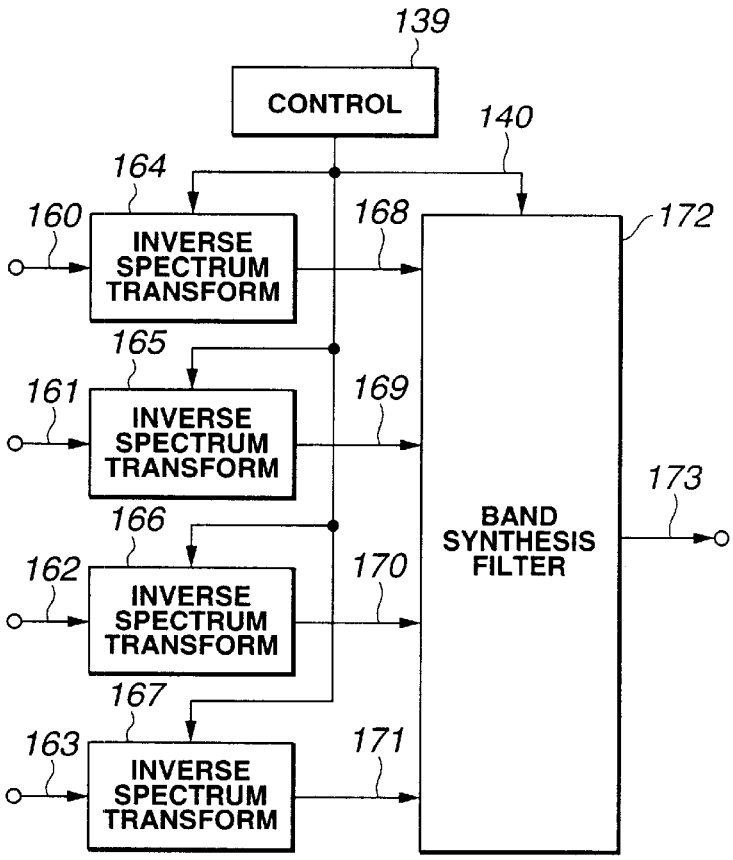
FIG. 10 is a block diagram of the inverse transformer provided in the partial decoder in FIG. 8.

FIG. 10 shows in detail the inverse transformer 145 provided in the partial decoder in FIG. 8.

As shown, the inverse transformer 145 includes inverse spectrum transformers 164, 165, 166 and 167 and a band synthesis filter 172. The inverse spectrum transformers 164, 165, 166 and 167 make inverse spectrum transformation of input signals 160, 161, 162 and 163, respectively, according to the control signal 140 from the controller 139 to restore signals 168, 169, 170 and 171 in different frequency bands, respectively. More particularly, for the pitch shifting as in the above, the inverse spectrum transformers 164, 165, 166 and 167 make inverse spectrum transformation of only signals in desired bands corresponding to the pitch shifting. For example, for shifting the pitch to a two octaves higher band, the inverse spectrum transformers 164, 165, 166 and 167 make inverse spectrum transformation for the one lowest frequency band, while making inverse spectrum transformation for the two low frequency bands for shifting the pitch to a one octave higher band. Note that the input signals 160, 161, 162 and 163 correspond to the signal 142 in FIG. 8.

The band synthesis filter 172 synthesizes a synthetic signal 173 from the frequency-band signals supplied from the inverse spectrum transformers 164 to 167 according to the control signal 140 from the controller 139. More specifically, for the pitch shifting as in the above, the band synthesis filter 172 synthesizes the synthetic signal 173 from the signals of different frequency bands inversely transformed in spectrum correspondingly to the pitch shift. For example, when shifting the pitch to a two octave higher band, for example, the band synthesis filter 172 provides a synthetic signal 173 in one lowest frequency band after inversely transformed in spectrum. For shifting the pitch to a one octave higher band, the band synthesis filter 172 provides a synthetic signal 173 in two low frequency bands, after inversely transformed in spectrum. The synthetic signal 173 corresponds to the signal 144 in FIG. 8.

The inverse transformer 145 constructed as shown in FIG. 10 is adapted to decode at a high speed with not many operations for the pitch shifting. Generally, the inverse spectrum transformation needs a vast amount of signal processing. As in this embodiment, however, it is possible to reduce the amount of processing by making inverse spectrum transformation of only the low frequency band during the pitch shifting. This is also true about the band synthesis filter 172.

In the first embodiment, when the pitch of a signal is shifted to a higher frequency band, the band of the signal to be decoded for reproduction becomes narrower in inverse proportion to the pitch shifting to the higher frequency band. Thus the first embodiment is very effective for a pitch shift to a very high frequency band. For shifting the pitch to a lower frequency band than that of an original sound signal, there is no problem in the decoding speed and thus all the frequency bands are used.

Figure 11:
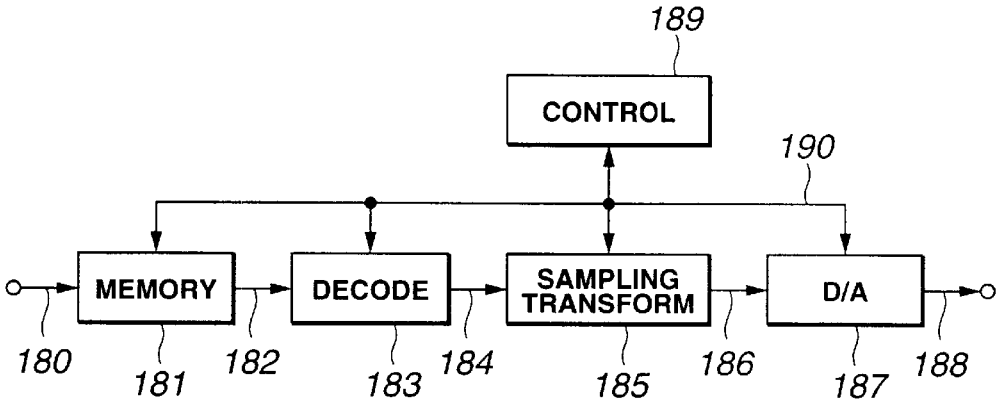
FIG. 11 is a schematic block diagram of a second embodiment of the pitch-shifting decoder according to the present invention.

FIG. 11 shows a construction example of a second embodiment of the pitch-shifting decoder according to the present invention. This decoder is an audio signal decoding reproducer adapted to decoding a code string generated by the encoder while shifting the pitch of the sound. As shown, the decoder includes a memory 181, decoder 183, sampling transformer 185, D/A converter 187 and a controller 189. In this decoder, a coded audio signal stored in the memory 181 is reproduced while being shifted in pitch as necessary.

As shown in FIG. 11, an input signal 180 is a code string (coded data) as shown in FIG. 5, generated by compressing coding of an audio PCM signal sampled with the frequency of 48 kHz. The input signal 180 is stored once in the memory 181.

The memory 181 is a semiconductor memory for example. As in the first embodiment, data write to and read from the memory 181 can be made at an arbitrary speed according to a control signal 190 from the controller 189. Also, the memory 181 can provide the same data part of an audio signal repeatedly. The speed of data read from the memory 181 is controlled based on the control signal 140 produced by the controller 139 according to a pitch select signal designated by the user. For example, when the sound pitch is shifted to a one octave higher frequency band, the reading speed is two times higher than that in the ordinary reproduction. When the pitch is shifted to a two octaves higher frequency band, the read is made from the memory 181 at a speed four times higher than that in the ordinary reproduction. On the contrary, however, for shifting the pitch to a one octave lower frequency band, the reading speed is a half of that in the ordinary reproduction. When the pitch is shifted to a two octaves lower frequency band, the read is made from the memory 181 at a speed being a quarter of that in the ordinary reproduction.

The decoder 183 decodes a code string 182 supplied from the memory 181 according to the control signal 190 (pitch select signal) from the controller 189. For example, when the pitch is shifted to a higher frequency band, the decoder 183 decodes only the coded data in a desired low frequency band and zero data of other than the low frequency band while zeroing other than the coded data in the desired low frequency band of the code string in FIG. 5. The desired low frequency band of the coded data is similar to that in the first embodiment. The decoder 183 essentially has to decode only the coded data in the desired low frequency band and has not to decode the zero data in other than the low frequency band, so the decoder 183 can decode at a higher speed with not many operations than in the reproduction of a sound signal with decoding of coded data in all frequency bands and pitch shifting. In the foregoing, the decoding with pitch shifting has been described. However, when no pitch shifting is effected or when the pitch is shifted to be lower, the decoder 183 will decode coded data in all frequency bands. The decoder 183 is basically constructed as in FIGS. 8 to 10. A decoded data (time-series audio data 184) produced by the decoding in the decoder 183 is sent to the sampling transformer 185.

The sampling transformer 185 re-samples the time-series signal decoded with the pitch shifting as in the above with an original sampling frequency, or 48 kHz as will be described later. An audio data 186 re-sampled by the sampling transformer 185 is sent to the D/A converter 187.

The D/A converter 187 converts the audio data 186 re-sampled by the sampling transformer 185 to an analog audio signal 188. In this second embodiment, since the sampling transformer 185 re-samples as in the above, the D/A converter 187 can use a constant clock equivalent to the sampling frequency of 48 kHz of the original audio signal.

Figure 12:
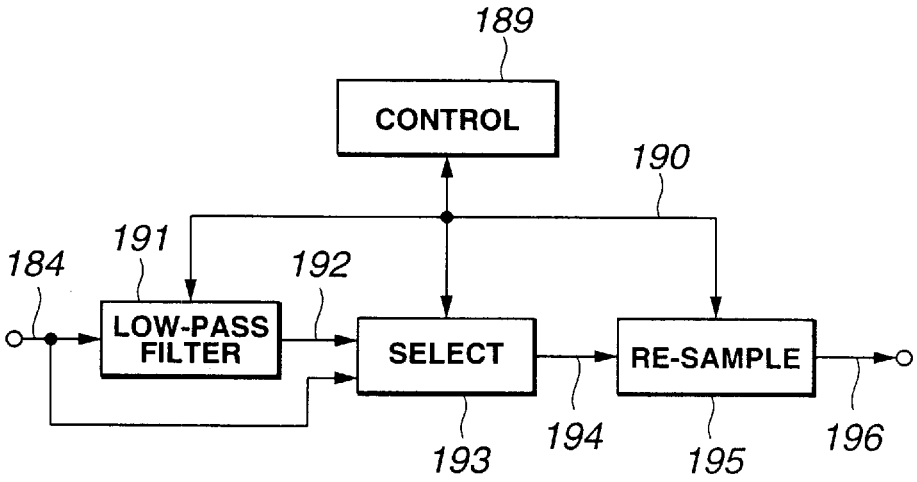
FIG. 12 is a block diagram of the sampling transformer provided in the decoder in FIG. 11.

FIG. 12 shows a construction example of the sampling transformer 185 provided in the decoder in FIG. 11.

As shown in FIG. 12, the sampling transformer 185 includes a low-pass filter 191, selector 193 and a re-sampling circuit 195. As shown, the input signal 184 to the sampling transformer 185 is supplied to as low-pass filter 191 which will make low-pass filtering of the input signal 184 according to the control signal 190 from the controller 189. Note that the input signal 184 in FIG. 12 corresponds to the signal 184 in FIG. 11.

Figure 13:
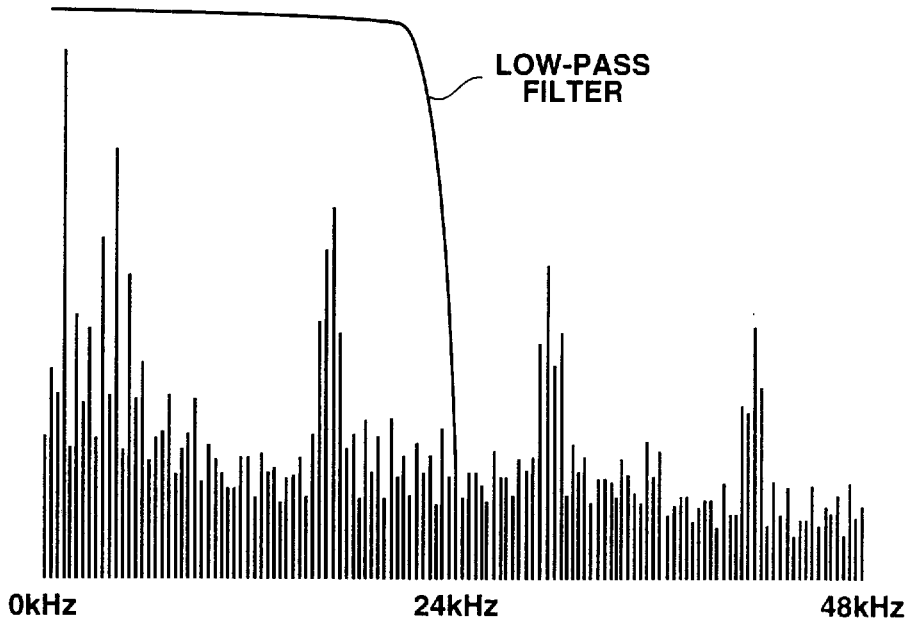
FIG. 13 explains the low-pass filter provided in the decoder in FIG. 11.

For example, when the pitch is shifted to a one octave higher frequency band, namely, when the reproduction by decoding is effected at a two times higher speed as shown in FIG. 13 explaining the low-pass filter 191 provided in the decoder in FIG. 1, the band of the signal reproduced by decoding will be two times wider. When the signal is re-sampled with the original sampling frequency, or 48 kHz in this embodiment, the signal shifted to a frequency band higher than 24 kHz will be aliased to a frequency band lower than 24 kHz. Therefore, when the pitch is shifted to a higher frequency band according to the control signal 190 from the controller 189, the low-pass filter 191 will pass only the frequency bands lower than 24 kHz of the input signal 184 (while blocking the bands higher than 24 kHz) as shown in FIG. 13. In this case, according to the control signal 190, a filter factor to meet the low-pass characteristic of the low-pass filter 191 is selected for the low-pass filter 191. Note that when the pitch is not to be shifted, or when the pitch is to be shifted to be lower, the band of the audio signal will be narrower. So no band limitation by the low-pass filter 191 is required. The low-pass filter 191 provides a signal 192 which will be sent to the selector 193.

The selector 193 is supplied with the signal 192 from the low-pass filter 191 and the input signal 184 from the decoder 183, and selects either the signal 192 from the low-pass filter 191 or the input signal 184 from the decoder 183 according to the control signal 190 from the controller 189. That is, for a pitch shift to a higher frequency band, the selector 193 will select the input signal 192 from the low-pass filter 191. For no pitch shifting or for a pitch shift to a lower frequency band, the selector 193 will select the input signal 184 from the decoder 183. The selector 193 will provide a signal 194 which is sent to the re-sampling circuit 195.

In the above description, the sampling transformer 185 uses the low-pass filter for elimination of the aliasing. However, by filling zero data in other than the desired low frequency band (or processing only the data in the low frequency band, not the data of the high frequency band) as in the decoder 183, aliasing can be prevented even with the data not passed through the low-pass filter.

The re-sampling circuit 195 re-samples the data by the method which will be described with reference to FIG. 14 to provide an audio PCM data 196 of the original sampling frequency of 48 kHz. Note that the audio PCM data 196 corresponds to the signal 186 in FIG. 11.

Figure 14:
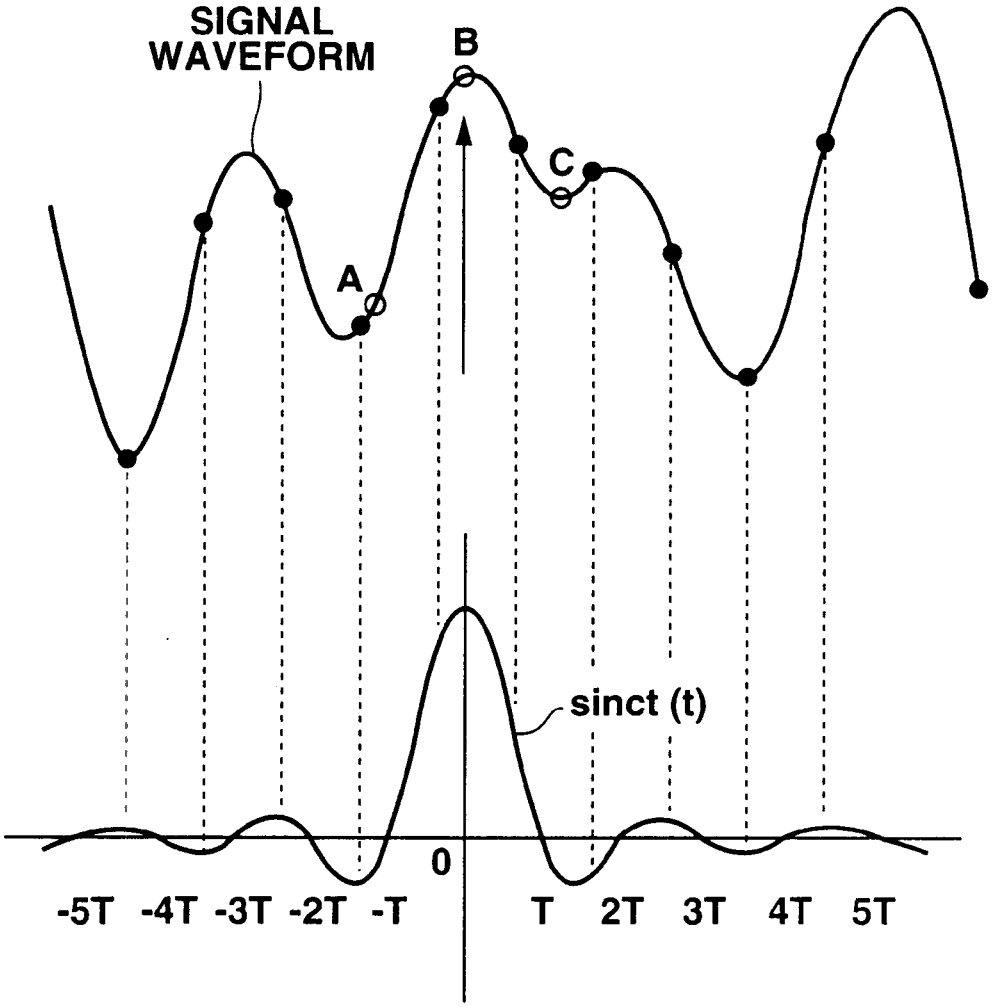
FIG. 14 explains the re-sampling effected in the sampling transformer provided in the decoder in FIG. 11.

FIG. 14 explains the re-sampling effected in the sampling transformer 185 provided in the decoder in FIG. 11. In FIG. 14, the block spots on the signal waveform indicate points where the output signal (PCM signal) 184 from the decoder 183 in FIG. 11 was sampled, and white spots on the signal waveform indicate points where sampling was made with the original sampling frequency of 48 kHz. Generally, as well known as the sampling theorem, when the band of a continuous function f(t) is limited to a half of the sampling frequency, the function f(t) can uniquely be restored as given by the following expression from a sample acquired at every interval T.

$$f(t) = \sum_{n=-\infty}^{\infty} f(nT)\sin vT(t-nT)$$

where sinc T(t)=sin (πt/T)/(πt/T) and sinc T(0)=1.

As will be seen from FIG. 14, the sample value at the white spot B for example can be acquired by convolution of the sample points (black spots on the signal waveform) and sample points on a waveform of sinc T(t). However, since the waveform of sinc T(t) takes sufficiently small values at opposite ends thereof, it should be punctuated with a finite product-sum term determined depending upon a necessary accuracy of calculation.

According to the second embodiment of the present invention, the decoding operation is made at a higher speed. However, zeroing data the data of high frequency band which will not be necessary for a pitch shift to a higher frequency allows the necessary amount of processing smaller than in decoding data in all the frequency bands, thereby permitting a reduction in the load to the decoder. Therefore, a pitch shift to a higher frequency can be made with no increase in hardware scale and costs.

As in the foregoing, the coded data is acquired by dividing the frequency band of a signal into subbands by the subband filter and then decoding them to spectrum signals for coding. However, a coded data may be acquired by transforming a PCM signal directly to spectrum signals by the transform such as MDCT and then coding them, and the coded data thus acquired may be shifted in pitch according to the present invention. Also in this case, the amount of processing for a pitch shift to a higher frequency can be reduced by decoding only the signals in low frequency bands.

The embodiments having been described in the foregoing adopt the four subbands. However, the present invention is applicable to more than four subbands, namely, to six, eight, ten, twelve, . . . , or more subbands. The pitch can also be shifted using three low frequency ones of the four subbands.

Figure 15:
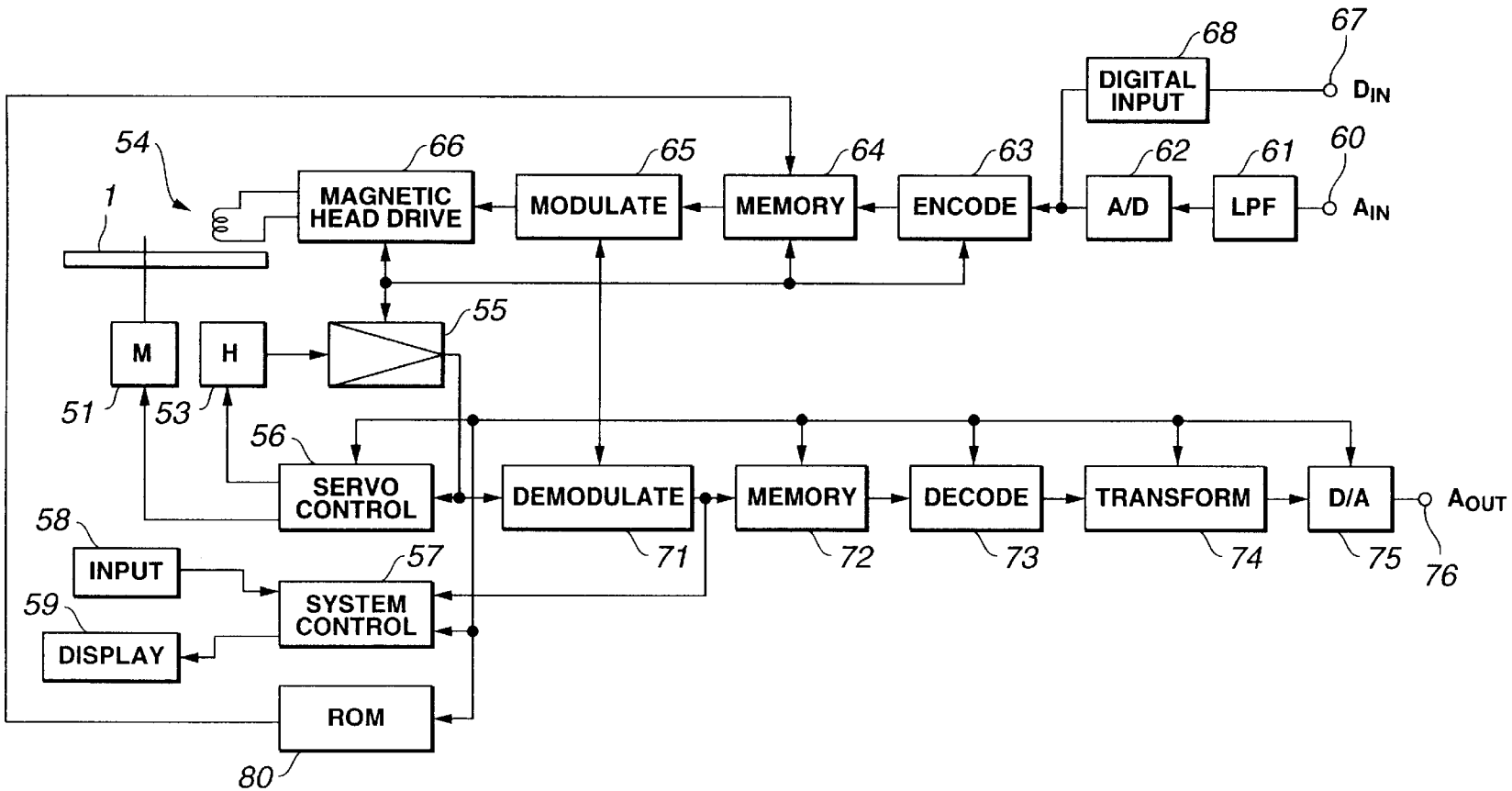
FIG. 15 is a block diagram of a compressed data recording and/playback apparatus in which the encoder and decoder according to the present invention are employed.

FIG. 15 is a block diagram of a compressed data recording and/or playback apparatus in which the encoder and decoder according to the present invention are employed.

In the compressed data recording and/or playback apparatus shown in FIG. 15, a magneto-optical disc 1 is used as a recording medium. The magneto-optical disc 1 is driven to rotate by a spindle motor (M) 51. For write of data to the magneto-optical disc 1, an optical head (H) 53 irradiates a laser light to the magneto-optical disc 1 while a magnetic head 54 applies to the disc 1 a modulated magnetic field corresponding to a data to write. The so-called magnetic modulation is effected to write the data along a recording track on the magneto-optical disc 1. For read of data from the magneto-optical disc 1, the recording track on the magneto-optical disc 1 is traced with the laser light from the optical head 53 to read the data magneto-optically.

The optical head (H) 53 includes a laser source such as a laser diode, optical parts such as collimator lens, objective lens, polarizing beam splitter, cylindrical lens, etc., a photodetector having a predetermined pattern of photosensors, etc. The optical head 53 is disposed opposite to the magnetic head with the magneto-optical disc 1 placed between them. For data write to the magneto-optical disc 1, the magnetic head 54 is driven by a magnetic head drive circuit 66 included in a recording system which will further be described later to apply to the magneto-optical disc 1 a modulated magnetic field corresponding to a data to write, and the optical head 53 irradiates a laser light to a selected track on the magneto-optical disc 1. Thereby the data is thermo-magnetically recorded in the magneto-optical disc 1 by the magnetic modulation method. The optical head 53 detects a return component of the laser light irradiated to the selected track to detect a focus error by the so-called astigmatic method for example and also a tracking error by the so-called push-pull method for example. For data read from the magneto-optical disc 1, the optical head 53 detects the focus error and tracking error while detecting an error of the polarizing angle (Kerr rotation angle) of the return component of the laser light from the selected track on the magneto-optical disc 1, thereby producing a read signal.

An output from the optical head 53 is supplied to an RF circuit 55 which will extract from the output from the optical head 53 the focus error and tracking error and supply them to a servo control circuit 56, while making a binary coding of the read signal and supplying it to a demodulator 71 of a playback system which will further be described.

The servo control circuit 56 consists of, for example, a focus servo control circuit, tracking servo control circuit, spindle motor servo control circuit, sled servo control circuit, etc. The focus servo control circuit is provided to control the focus of the optical system of the optical head 53 so that the focus error signal will be zero. The tracking servo control circuit is provided to control the tracking of the optical system of the optical head 53 so that the tracking error signal will be zero. Further, the spindle motor servo control circuit is provided to control the spindle motor 51 to drive to rotate the magneto-optical disc 1 at a predetermined speed (for example, a constant linear velocity). The sled servo control circuit is provided to move the optical head 53 and magnetic head 54 to a track on the magneto-optical disc 1 that is designated by a system controller 57. The servo control circuit 56 consisting of the above servo control circuits send to the system controller 57 information indicative of the operating status of each component unit controlled by the servo control circuit 56.

The system controller 57 has connected thereto a key input/operation unit 58 and display 59. The system controller 57 controls the recording and playback systems according to input operation information supplied from the key input/operation unit 58. Also, according to address information whose minimum unit is a sector, reproduced from a recording track on the magneto-optical disc 1 according to a header time, cue (Q) data of subcodes, etc., the system controller 57 controls the writing and reading positions on the recording track being traced by the optical head 53 and magnetic head 54. Further, according to a data compression ratio of this compressed data recording and/or playback apparatus and information indicative of a reading position on the recording track, the system controller 57 controls the display 59 to display a read time. Moreover, the system controller 57 performs also the functions of the controllers 139 and 189 having previously been described.

For the above display of a read time, address information in sectors (absolute time information), reproduced from the recording track on the magneto-optical disc 1 according to a so-called heater time, cue (Q) data of subcodes, etc. is multiplied by an inverse number of the data compression ratio (for example, 4 when the compression ratio is 1/4) to determine actual time information which will be indicated in the display 59. Also during data recording, if absolute time information is preformatted on the recording track on the magneto-optical disc or the like, the preformatted absolute time information is read and multiplied by an inverse number of the data compression ratio to determine an actual read time. A current position on the recording track can be indicated with the actual read time thus determined.

Next in the recording system of the disc recording and/or playback apparatus, an analog audio input signal $A_{IN}$ from an input terminal 60 is supplied to an A/D converter 62 via a low-pass filter (LPF) 61. The A/D converter 62 quantizes the analog audio input signal $A_{IN}$. A digital audio signal produced by the A/D converter 62 is supplied to an adaptive transform coding (ATC) encoder 63. Also, a digital audio input signal $D_{IN}$ from an input terminal 67 is supplied to the ACT encoder 63 via a digital input interface circuit (digital input) 68. The ATC encoder 63 shown in FIG. 12 makes a bit compression (data compression), at a predetermined data compression ratio, of a digital audio PCM data resulted from quantization of the input signal $A_{IN}$ by the A/D converter 62 and whose transfer rate is a predetermined one, and provides a compressed data (ATC data) which will be supplied to a memory 64. When the data compression ratio is 1/8 for example, the compressed data will be transferred at a rate equal to 1/8 (9.375 sectors/sec) of a data transfer rate (75 sectors/sec) of a data in the standard CD-DA format.

Write and read of data to (from ROM 80) and from the memory 64 is controlled by the system controller 57. The memory 64 provisionally stores the ATC data supplied from the ATC encoder 63. It is used as a buffer memory for storage of data to be written to the disc as necessary. More specifically, when the data compression ratio is 1/8, the compressed audio data supplied from the ATC encoder 63 has the data transfer rate thereof reduced to 1/8 of the data transfer rate (75 sectors/sec) for data in the standard CD-DA format, namely, to 9.375 sectors/sec. The compressed data will continuously be written into the memory 64. Thus it suffices to record the compressed data (ATC data) at every eight sectors. However, since it is actually impossible to record the compressed data at every eight sectors, the compressed data are recorded at every sector as will be described later. For this recording, a cluster consisting of a predetermined number of sectors (for example, 32 sectors+several sectors) is used as a unit of recording, and the compressed data are recorded at a burst at the same data transfer rate (75 sectors/sec) as for data in the standard CD-DA format.

That is, the ATC audio data compressed at a ratio of 1/8, continuously written in the memory 64 at a transfer rate as low as 9.375 sectors/sec (=75/8) corresponding to the bit compression ratio, will be read at a burst as recorded data from the memory 64 at the transfer rate of 75 sectors/sec. The data to be read and written will be transferred at a general data transfer rate of 9.375 sectors/sec including a write-pause period, while it will be transferred at the standard transfer rate of 75 sectors/sec momentarily for a time of a data recording effected at a burst. Therefore, when the disc rotating speed is the same (constant linear velocity) as for the data in the standard CD-DA format, recording will be done at the same recording density and in the same storage pattern as those for the data in the standard CD-DA format.

The ATC audio data, namely, recorded data, read at a burst from the memory 64 at the transfer rate (momentary) of 75 sectors/sec is supplied to a modulator 65. In the data string supplied from the memory 64 to the modulator 65, the unit of data to be recorded at a burst is a cluster of a plurality of sectors (32 sectors) and several sectors disposed before and after the cluster to join successive clusters to each other. The cluster joining sectors are set longer than the interleave length in the modulator 65 and will not affect the data in other clusters even when they are interleaved.

The modulator 65 makes an error-correcting coding (parity addition and interleaving) and EFM coding of the recorded data supplied at a burst from the memory 64 as in the above. The recorded data subjected the above-mentioned coding by the modulator 65 is supplied to a magnetic head drive circuit 66. The magnetic head drive circuit 66 has the magnetic head 54 connected thereto, and drives the magnetic head 54 so as to apply the magneto-optical disc 1 with a modulated magnetic field corresponding to the recorded data.

The system controller 57 controls the memory 64 as in the above while controlling the writing position so that the recorded data read at a burst from the memory 64 under the control as in the above is continuously written to the recording track on the magneto-optical disc 1. The writing position control is effected by controlling the writing position for the recorded data read at a burst from the memory 64 under the control of the system controller 57 and supplying the servo control circuit 56 with a control signal for designating a writing position on the recording track on the magneto-optical disc 1.

Next, the playback system of the compressed data recording and/or playback apparatus will be described herebelow. The playback system is to play back the recorded data continuously recorded along the recording track on the magneto-optical disc 1 by the recording system as in the above. It includes a demodulator 71 supplied with a read output acquired by tracing a recording track on the magneto-optical disc 1 with a laser light by the optical head 53 and which is binary-coded by an RF circuit 55. Note that this playback apparatus can not only read a magneto-optical disc but also a read-only optical disc being a so-called compact disc (CD, trademark).

The demodulator 71 is provided correspondingly to the modulator 65 included in the recording system. It makes an error-correcting decoding and EFM decoding of the read output binary-coded by the RF circuit 55 and reads the ATC audio data compressed at the above ratio of 1/8 at the transfer rate of 75 sectors/sec higher then the normal transfer rate. The read data provided from the demodulator 71 is supplied to a memory 72 being the memory 131 in FIG. 6 or memory 181 in FIG. 11.

Write and read of data to and from the memory 72 is controlled by the system controller 57. The read data supplied at the transfer rate 75 sectors/sec from the demodulator 71 is written at a burst into the memory 72 at the transfer rate of 75 sectors/sec. From this memory 72, the read data written at a burst at the transfer rate of 75 sectors/sec is continuously read at the transfer rate of 9.375 sectors/sec corresponding to the data compression ratio of 1/8.

The system controller 57 allows to write the read data into the memory 72 at the transfer rate of 75 sectors/sec, and provides a memory control to read from the read data continuously from the memory 72 at the transfer rate of 9.375 sectors/sec. In addition to the above memory control, the system controller 57 controls the reading position so that the read data written at a burst from the memory 72 under the memory control is continuously read from the recording track on the magneto-optical disc 1. The reading position control is such that the reading position for the read data read at burst from the memory 72 is controlled by the system controller 57 and the servo control circuit 56 is supplied with a control signal for designating a reading position on a recording track on the magneto-optical disc or optical disc 1.

An ATC audio data provided as the read data continuously read from the memory 72 at the transfer rate of 9.375 sectors/sec is supplied to an ATC decoder 73 being the decoder 133 in FIG. 6 or decoder 183 in FIG. 11. The ATC decoder 73 corresponds to the ATC encoder 63 included in the recording system, and it reads a 16-bit digital audio data by expanding the ATC data eight times for example (bit expansion). The digital audio data from the ATC decoder 73 is supplied to a transformer 74 being the sampling transformer 185 in FIG. 11.

The signal shifted in pitch or re-sampled in the transformer 74 is supplied to a D/A converter 74 being the D/A converter 137 in FIG. 6 or D/A converter 197 in FIG. 11.

The D/A converter 74 converts the digital audio signal supplied from the ATC decoder 73 to an analog signal and provides an analog audio signal $A_{OUT}$. The analog audio signal $A_{OUT}$ provided from the D/A converter 74 is delivered at an output terminal 76 via a low-pass filter 75.

For the pitch shifting, data decoding and reading are effected at a speed corresponding to the pitch shift under the control of the system controller 57.

Figure 16:
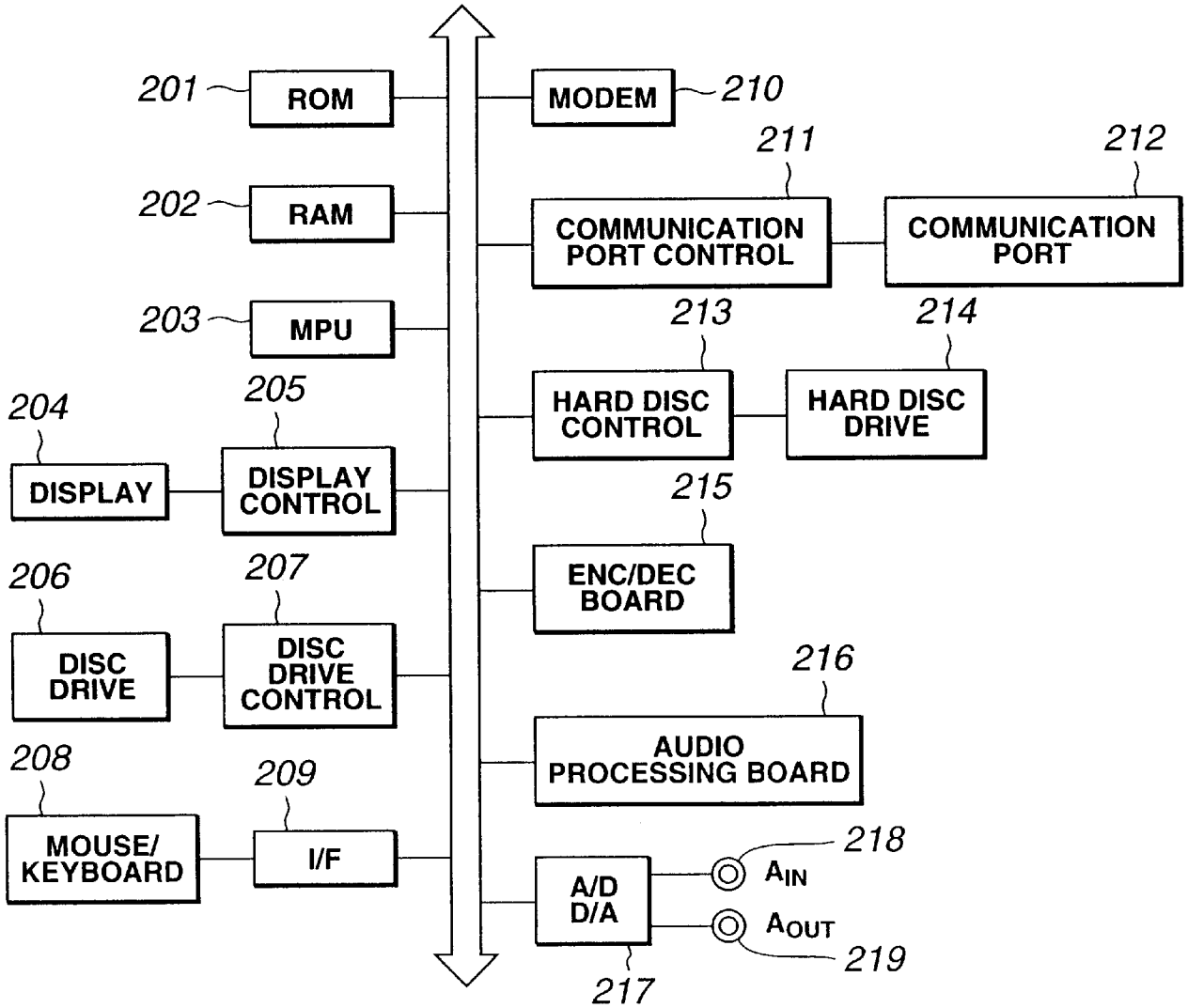
FIG. 16 is a block diagram of a personal computer in which the encoder and decoder according to the present invention are employed.

Referring now to FIG. 16, there is schematically illustrated in the form of a block diagram a personal computer in which the aforementioned embodiments of the encoder and decoder according to the present invention are employed.

The personal computer shown in FIG. 16 implements the functions of the aforementioned embodiments of the present invention according to an application program.

As shown in FIG. 16, the personal computer includes mainly a ROM 201, RAM 202, MPU (microprocessor) 203, display 204, display controller 205, disc drive 206, disc drive controller 207, mouse and keyboard 208, interface (I/F) 209, modem 210, communication port controller 211, communication port 212, hard disc controller 213, hard disc drive 214, ENC/DEC board 215, audio processing board 216, and an A/D and D/A converter 217. The MPU 203 shifts the sound pitch as in the aforementioned embodiments according to the application program stored in the RAM 202. The ROM 201 saves initial settings, etc. of the personal computer.

The hard disc in the hard disc drive 214 stores the application program which will be stored into the RAM 202 via the hard disc controller 213. The application program is recorded in a CD-ROM, DVD-ROM or the like loaded in the disc driver 206, and stored into the hard disc by reading it from the disc. Note that the application program can be down-loaded from the server via the model 210 and also supplied from outside via the communication port controller 211 and communication port 212.

The ENC/DEC board 215 codes and decodes the data as in the aforementioned embodiments of the present invention. Note that this board is unnecessary when the MPU 203 can code and decode the data in a real-time manner.

The audio processing board 216 makes a pitch shifting and sampling-transformation as in the aforementioned embodiments of the present invention. Note that if the MPU 203 can make a real-time pitch shifting and sampling-transformation, this board 216 is not necessary.

The A/D and D/A converter 217 makes an A/D conversion and D/A conversion of an audio signal. The audio signal converted from digital to analog is delivered at an audio output terminal 219, and an audio signal supplied from an audio input terminal 218 is converted from analog to digital.

The display 204 and mouse and keyboard 208 are accessory to an ordinary personal computer. The display 204 is controlled by the display controller 205, and an operation signal or command supplied from the mouse or keyboard 208 is acquired via the interface (I/F) 209.

What is claimed is:

1. A signal processing method for decoding a coded signal for reading, comprising:

setting a pitch for the coded signal to a higher band;

decoding only a low frequency portion of the coded signal according to the set pitch at a relatively increased speed; and shifting the pitch of the decoded signal to said higher band based on the set pitch.

2. The method as set forth in claim 1, wherein the coded signal is one acquired at least by dividing a frequency band of a signal into subbands and then coding the subbands; and wherein only a low frequency one, corresponding to the set pitch, of the subbands is decoded.

3. The method as set forth in claim 1, wherein the coded signal is one acquired at least by transforming a signal to frequency components and then coding the frequency components; and wherein only a low frequency one, corresponding to the set pitch, of the transformed frequency components, is decoded.

4. The method as set forth in claim 1, wherein a digital read signal whose pitch has been shifted based on the set pitch is converted to an analog read signal with a clock corresponding to the set pitch.

5. The method as set forth in claim 1, wherein at a time of pitch shifting, only a low frequency portion of the decoded read signal is sampling-transformed based on the set pitch.

6. The method as set forth in claim 1, wherein at a time of pitch shifting, zero is inserted at a high frequency portion of the decoded read signal and the high frequency portion is sampling-transformed based on the set pitch.

7. An information processing method for decoding a coded signal for reading, comprising:

setting a pitch for the coded signal to a higher band;

decoding the coded signal with zero inserted at a high frequency portion, corresponding to the set pitch, of the coded signal at a relatively increased speed; and generating a read signal having a pitch corresponding to the set pitch.

8. A signal processing apparatus for decoding a coded signal for reading, comprising:

means for setting a pitch for the coded signal to a higher band;

means for decoding only a low frequency portion of the coded signal according to the set pitch at a relatively increased speed; and means for transforming the pitch of the decoded signal based on the set pitch to said higher band.

9. The apparatus as set forth in claim 8, wherein the coded signal is a one acquired at least by dividing the frequency band of a signal into subbands and then coding the subbands; and wherein only a low frequency one, corresponding to the set pitch, of the subbands is decoded.

10. The apparatus as set forth in claim 8, wherein the coded signal is one acquired at least by transforming a signal to frequency components and then coding the frequency components; and wherein only a low frequency one, corresponding to the set pitch, of the transformed frequency components, is decoded.

11. The apparatus as set forth in claim 8, wherein a digital read signal whose pitch has been shifted based on the set pitch is converted to an analog read signal with a clock corresponding to the set pitch.

12. The apparatus as set forth in claim 8, wherein at a time of pitch shifting, only a low frequency portion of the decoded read signal is sampling-transformed based on the set pitch.

13. The apparatus as set forth in claim 8, wherein at a time of pitch shifting zero is inserted at a high frequency portion of the decoded read signal and the high frequency portion is sampling-transformed based on the set pitch.

14. A signal processing apparatus for decoding a coded signal for reading, comprising:

means for setting a pitch for the coded signal to a higher band;

means for decoding the coded signal with zero inserted at a high frequency of the coded signal according to the set pitch at a relatively increased speed; and means for generating a read signal having a pitch corresponding to the set pitch.

15. An information serving medium for serving a program according to which a coded signal is decoded and read, the program comprising:

setting a pitch for the coded signal to a higher band;

decoding only a low frequency portion of the coded signal according to the set pitch at a relatively increased speed; and shifting the pitch of the decoded signal based on the set pitch to said higher band.

16. An information serving medium for serving a program under which a coded signal is decoded and read, the program comprising:

setting a pitch for the coded signal to a higher band;

decoding the coded signal with zero inserted at a high frequency portion of the coded signal according to the set pitch at a relatively increased speed; and generating a read signal having a pitch corresponding to the set pitch.

* * * * *